109-11 SR
6/5/79 XR 4,157,071

United States Patent [19]
King

[11] 4,157,071
[45] Jun. 5, 1979

[54] DRIVE-THROUGH SERVICE WINDOW

[75] Inventor: Donald E. King, Louisville, Ky.

[73] Assignee: Ayr King Corporation, Louisville, Ky.

[21] Appl. No.: 930,330

[22] Filed: Aug. 2, 1978

[51] Int. Cl.[2] ..... E05G 7/00
[52] U.S. Cl. ..... 109/19; 109/11
[58] Field of Search ..... 109/10, 11, 19, 66; 232/43.3, 44; 312/211

[56] References Cited

U.S. PATENT DOCUMENTS

| | | | |
|---|---|---|---|
| 1,882,835 | 10/1932 | Hanson et al. | 109/19 |
| 1,924,330 | 8/1933 | Scheeler | 109/19 |
| 3,702,101 | 11/1972 | Moore | 109/19 |

*Primary Examiner*—Mervin Stein
*Assistant Examiner*—David H. Corbin
*Attorney, Agent, or Firm*—Woodard, Weikart, Emhardt & Naughton

[57] ABSTRACT

Disclosed is a cylindrical housing mounted within a frame for rotation about its vertical, central, longitudinal axis. A chordal wall divides the cylinder into chordal segments and diametrically opposite access openings in the cylinder sidewall give access to each of the segments. A tray diametrically movable in one segment is controlled by a handle extending into the other segment. Sealing members prevent air leakage between the frame and the cylinder for all rotative positions of the cylinder within the frame.

6 Claims, 4 Drawing Figures

DRIVE-THROUGH SERVICE WINDOW

BACKGROUND OF THE INVENTION

While drive-through service windows have long been in use by banks, dry-cleaning establishments and fast food restaurants (see such prior art examples as U.S. Pat. Nos. 1,885,560 and 3,702,101), problems in their use have persistently remained. Pull-drawer types require substantial free space, particularly on the indoor side for manipulation of the drawer. Slide-door types, commonly used by fast food restaurants, allow insects to enter the food preparation area as they are manipulated. Frequent use of these windows in peak service periods during cold weather results in substantial thermal loss. In very cold periods the person manning the drive-through station must don special clothing and the duty at the station must be rotated among the personnel to prevent chilling and discomfort. Since drive-through service is a rapidly increasing component of modern fast food service volume (of the order of 25% to 40% in some locations); a drive-through service window assembly which avoids these problems becomes a highly valued equipment item in this trade.

The structure of the present invention utilizes a cylindrical housing mounted for rotation on a vertical axis and supported within a frame. The cylinder is divided into two segments by a chordal wall which is, preferrably, transparent (and may be made of bullet-proof glass for banking or late-open liquor store application). Access openings are made in the cylinder sidewall on opposite sides of the chordal wall. An extensible tray is provided in one of the segments, operated by a handle accessible in the other segment. This segmentally divided cylinder provides a maximum of usable product transfer space with a minimum of interior, free space required for operation. Seals are provided to cooperate with the walls of the cylinder so that in any position of the cylindrical housing, the assembly prevents entry of insects or exterior ambient air into the interior of the building. The concept of the present invention thus remedies the primary defects in prior art drive-through service window structures.

DESCRIPTION OF THE PREFERRED EMBODIMENT

Figure 1:
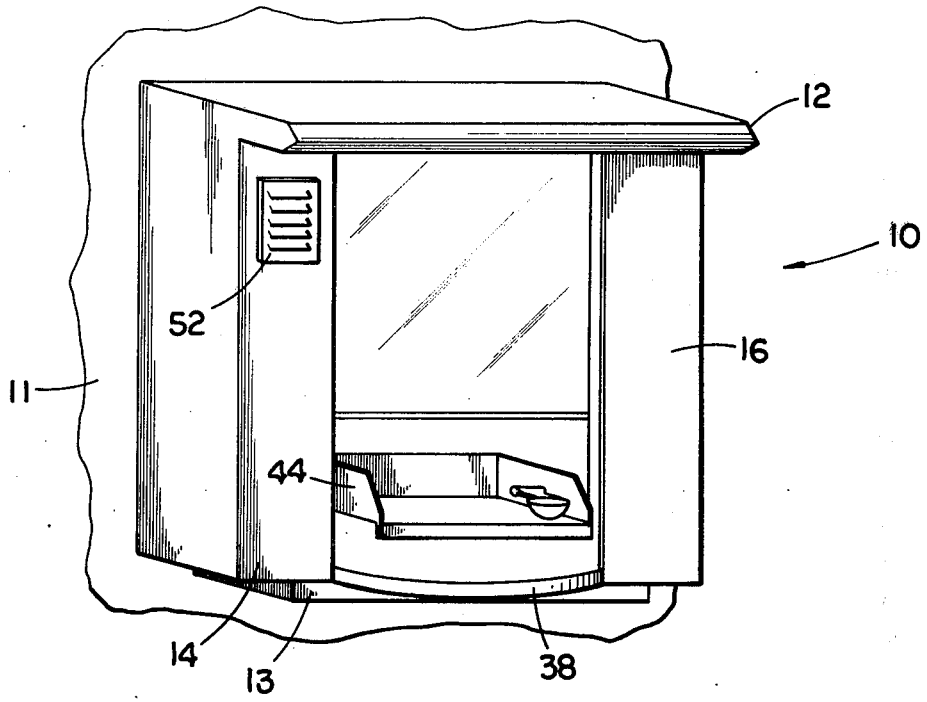
FIG. 1 is a perspective view of the assembly of the present invention viewed from the exterior of a building in which it is installed.
Figure 2:
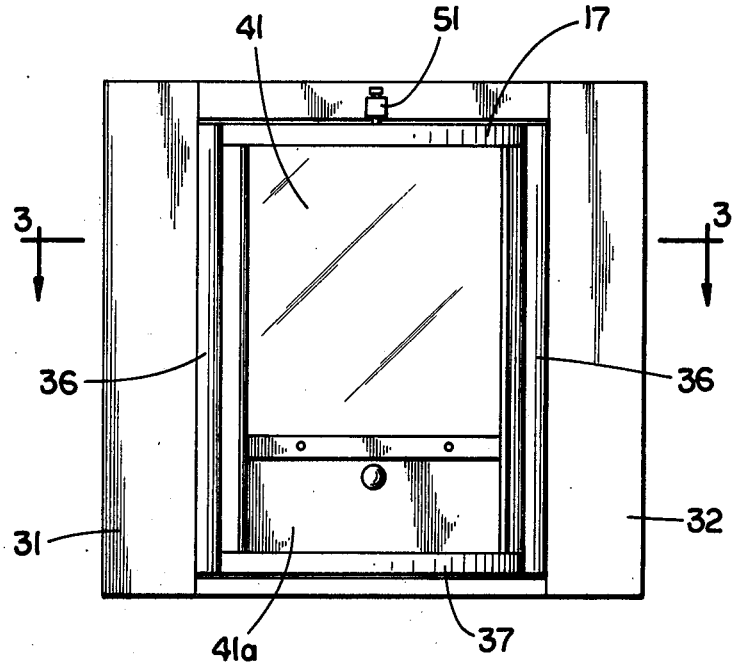
FIG. 2 is a front view of the assembly as viewed from the interior of the building.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being comtemplated as would normally occur to one skilled in the art to which the invention relates.

Referring initially to FIG. 1, the assembly of the present invention is shown generally at 10, installed in a place of business such as a fast food restaurant having an exterior wall surface 11. As may be seen in FIG. 1, a frame having horizontal top and bottom members 12 and 13, and vertical side members 14 and 16 forms the boundaries of the window opening through the exterior wall of the building. The cross-sectional contour of the frame members will be evident from FIGS. 3 and 4.

Figure 4:
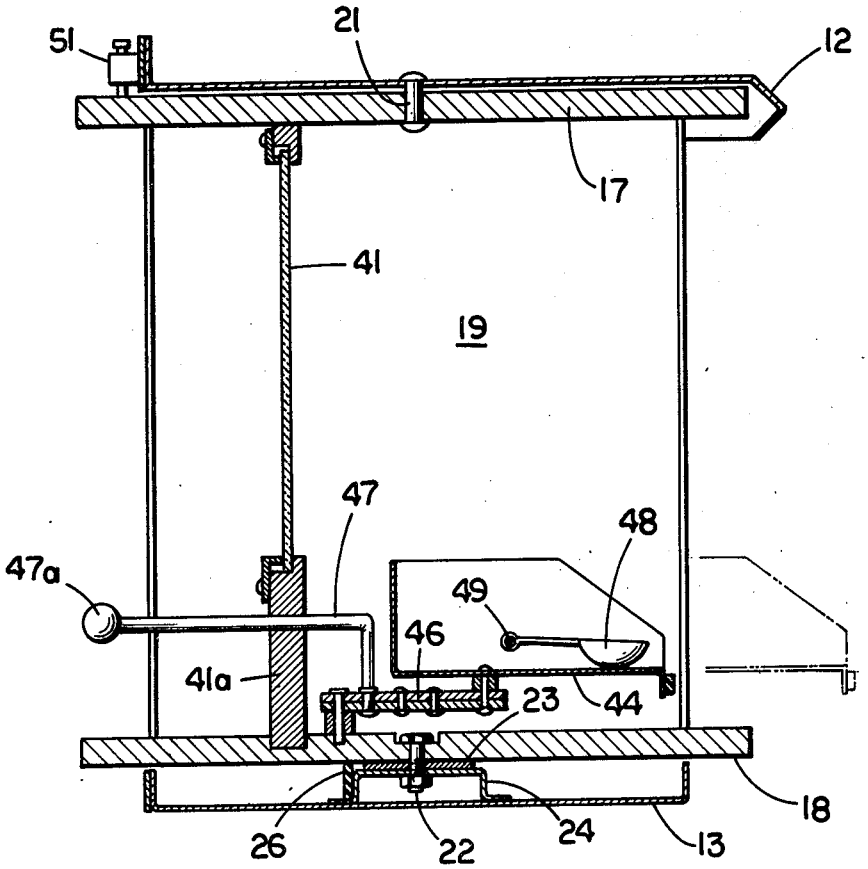
FIG. 4 is a side sectional view of the assembly.

As may best be seen in FIG. 4, a hollow, cylindrical housing having a top member 17, a bottom member 18 and a curved side wall 19 is supported for rotation on a vertical axis by the stub shafts 21 and 22. A thrust bearing member 23 is interposed between the member 18 and the adjacent support channel 24 carried by the central portion of the frame member 13. A flexible seal member 26 carried by channel 24 seals the area below the movable bottom member 18.

Figure 3:
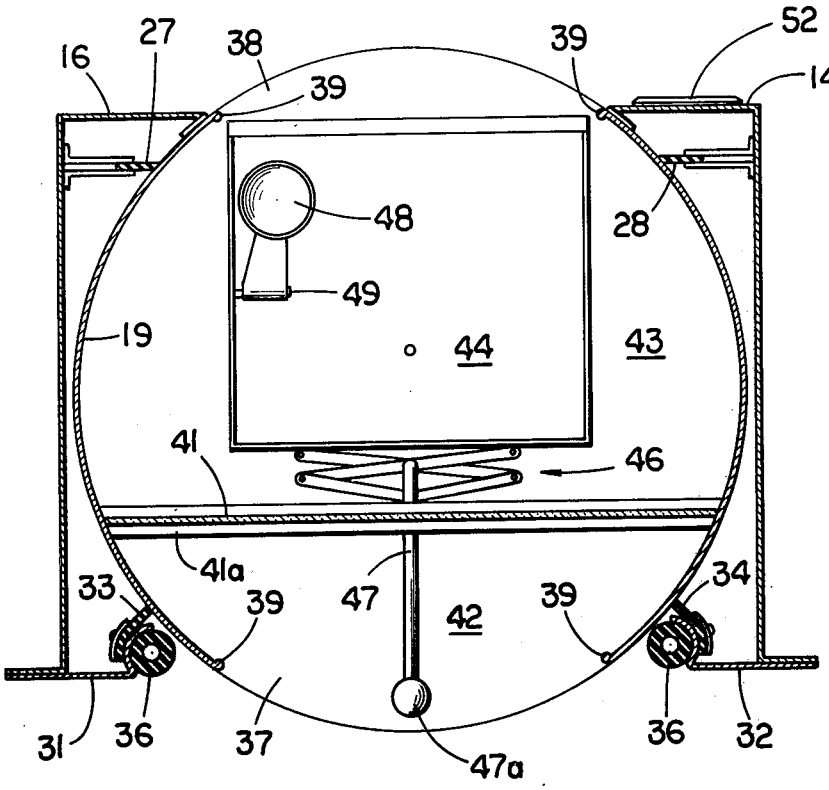
FIG. 3 is a sectional view taken generally along the line 3—3 of FIG. 2.

As may be seen in FIG. 3, flexible sealing members 27 and 28 extend from suitable mounting elements carried by frame members 16 and 14, and engage the outer surfaces of the curved sidewall 19. Inwardly projecting facing plates 31 and 32, carried by outwardly flanged portions of members 16 and 14, support flexible seals 33 and 34 which engage the movable sidewall 19. Vertical rubber guards 36 prevent wedging of fingers or implements in the junctional area between the stationary facing plates 31 and 32 as the cylinder sidewall 19 moves.

Opposite arcuate portions of the cylinder sidewall are cut away to provide diametrically opposed access openings 37 and 38 (FIG. 3), the edges of the sidewall being rolled to provide beads 39 bounding the access openings. A transverse wall 41 extends chordally across the cylinder and intersects the line of sight between access openings 37 and 38. The main portion of the wall is preferrably formed of a transparent material such as glass (bulletproof, for some applications) and the base portion **41*a* of the wall is rigidly secured to the member 18, the upper margin of the wall being suitably attached to the upper member 17. The chordal wall divides the cylinder into two unequally sized segments, indicated at 42** in FIG. 3.

Supported for radial, reciprocal motion within segment 42 is a rectangular tray 44 which is sized, in width, to permit it to move freely through the access openings 38. The retracted position of the tray is shown in solid lines in FIG. 4 and its extended position, in which it protrudes beyond the cylinder bottom member 18, is shown in broken lines. The base of the tray is connected to a conventional lazy tongs assembly, indicated at 46 and a handle element 47 is secured to the lazy tongs assembly and extends freely through an aperture in wall portion **41*a*, the shank of the handle being upwardly offset to place the knob end 47*a* of the handle at a convenient height above member 18. An operator, on the interior side of the wall in which the assembly is installed, may move the handle 47 rightwardly, as viewed in FIG. 4, and this motion will be multiplied and transferred to the tray 44** moving it to extended position.

The tray may be provided with a change receptacle or cup 48, pivotally attached at 49 to the side wall of the tray. The pivotal attachment permits bills to be placed under the change cup and change within the cup when payment or return change is transferred between the operator and the customer. The cyclindrical housing may be locked against rotation in the frame by any suitable means such as the simple latch bolt assembly 51

(FIG. 4), the bolt, when depressed, extending into a suitable aperture in the member 17. A speaker, indicated schematically at 52 (FIGS. 1 and 3) may be utilized to provide verbal communication between the operator and the customer.

In operation, assuming a conventional drive-through food service application, the customer places his order at a prior, phone-in station. He then drives up to the window in which the assembly of the present invention has been installed. The cylinder is, at this time, in initial position in which access opening 38 (as viewed in FIG. 3) faces the customer and the tray 44 has been placed in extended position. The customer places payment, for the product ordered, in the pivoted cup or receptacle 48. The food service operator on the interior of the building (at access opening 37 as viewed in FIG. 3) then manually retracts tray 44 into the interior of the cylinder utilizing handle 47, and manually rotates the cylinder through 180° placing access opening 38 adjacent the operator. The operator then places the ordered product on the tray and any change due in the receptacle 48. The operator then again rotates the drum through 180° and extends the tray so that the customer can remove the product from the tray and change from the receptacle. During this operation, it will be noted, the interior of the building remains substantially sealed against entry of outside air. The sealing members 33, 34, 37 and 38 are positioned so that, in any rotative position of the cylinder, two opposed sealing members are in engagement with the curved sidewall of the cylinder. Air bourne insects and dust are thus excluded and there is no substantial loss of air conditioning from the area adjacent the interior side of the window assembly. The window can easily be locked closed as by use of the bolt means 51.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A drive-through service window assembly for fast food restaurants or the like comprising a rectangular frame adapted for installation in an opening in an outside wall of a building, a hollow cylinder closed at its upper and lower ends and supported for rotation within said frame on its central longitudinal axis, said axis being disposed vertically within the frame, opposite arcuate portions of the cylinder sidewall being cut away to provide diametrically opposed access openings into the interior of the cylinder, a transverse wall extending chordally across the cylinder and intersecting the line of sight between said access oepings, a product serving member mounted in one of the cylinder segments formed by said transverse wall for movement along a diameter of said cylinder between a retracted position in which the serving member is within the cylinder and an extended position in which the serving member extends outside the cylinder, and means accessible in the other of the cylinder segments for moving said member between said positions.

2. A drive-through service window assembly as claimed in claim 1 including sealing members mounted on said frame and extending the length of said cylinder for sealing the space between the cylinder and the frame, said sealing members being disposed in diametrically opposite pairs and spaced from each other so that at least one seal member on each side of the frame engages the cylinder wall no matter what the rotative position of the cylinder in the frame.

3. A drive-through service window assembly assembly as claimed in claim 1 in which at least the eyelevel portion of said transverse wall is formed of transparent material.

4. A drive-through service window assembly as claimed in claim 1 in which said serving member takes the form of a tray disposed adjacent the base of said cylinder and said means for moving said serving member takes the form of a thrust member extending from the rear of the tray and through an aperture in said transverse wall.

5. A drive-through service window assembly as claimed in claim 4 in which a lazy tongs element is disposed between said thrust member and said tray to amplify the motion of said tray with respect to the motion of said thrust member.

6. A drive-through service window assembly as claimed in claim 1 in which the vertical junctional area between the cylinder and each side of said frame on the interior of the building is masked by elastomeric guard members.

* * * * *